US006039016A

United States Patent [19]

Noguchi

[11] Patent Number: 6,039,016

[45] Date of Patent: Mar. 21, 2000

[54] VALVE TIMING CONTROL DEVICE

[75] Inventor: Yuji Noguchi, Toyota, Japan

[73] Assignee: Aisin Seiki Kabushiki Kaisha, Aichi-pref, Japan

[21] Appl. No.: 09/179,895

[22] Filed: Oct. 28, 1998

[30] Foreign Application Priority Data

Oct. 30, 1997 [JP] Japan ..... 9-298785

[51] Int. Cl.[7] ..... F01L 1/344

[52] U.S. Cl. ..... 123/90.17; 123/90.31; 123/90.65

[58] Field of Search ..... 123/90.15, 90.17, 123/90.31, 90.65; 74/568 R; 464/1, 2, 160

[56] References Cited

U.S. PATENT DOCUMENTS

| | | | |
|---|---|---|---|
| 5,558,053 | 9/1996 | Tortul | 123/90.17 |
| 5,775,279 | 7/1998 | Ogawa et al. | 123/90.17 |
| 5,870,983 | 2/1999 | Sato et al. | 123/90.17 |

FOREIGN PATENT DOCUMENTS

| | | |
|---|---|---|
| 9-60507 | 3/1997 | Japan . |
| 9-264110 | 10/1997 | Japan . |
| 9-280017 | 10/1997 | Japan . |

*Primary Examiner*—Wellun Lo

*Attorney, Agent, or Firm*—Reed Smith Hazel & Thomas LLP

[57] ABSTRACT

A valve timing control device incorporates a cam shaft rotatably assembled within a cylinder head of an engine, a rotational transmitting member mounted around the peripheral surface of the cam shaft so as to rotate relatively thereto within a predetermined range for transmitting rotational power from a crank pulley. A plurality of vanes are provided on the cam shaft or the rotational transmitting member. Fluid chambers are formed between the cam shaft and the rotational transmitting member and separated into advancing chambers and delaying chambers by the vanes. A fluid supplying device supplies fluid under pressure to at least a selected one of the advancing chambers and the delaying chambers. A coil-spring is disposed between the cam shaft and the rotational transmitting member so as to expand one of the advancing chambers and the delaying chambers. A restricting device is used to restrict the radial movement of the coil-spring.

4 Claims, 3 Drawing Sheets

VALVE TIMING CONTROL DEVICE

FIELD OF THE INVENTION

The present invention relates to a valve timing control device and, in particular, to the valve timing control device for controlling an angular phase difference between a crank shaft of a combustion engine and a cam shaft of the combustion engine.

BACKGROUND OF THE INVENTION

In general, a valve timing of an internal combustion engine is determined by valve mechanisms driven by cam shafts according to either a characteristic or a specification of the internal combustion engine. Since a condition of the combustion is changed in response to the rotational speed of the combustion engine, however, it is difficult to obtain an optimum valve timing through the whole rotational range. Therefore, a valve timing control device which is able to change valve timing in response to the condition of the internal combustion engine as an auxiliary mechanism of the valve mechanism has been proposed in recent years.

A conventional device of this kind is disclosed, for example, in Unexamined Japanese Patent Publication (Kokai) No. Hei 9-264110. This device includes a cam shaft rotatably assembled with a cylinder head of an engine, a rotational transmitting member which is driven by the rotational torque from a crank shaft and which is rotatably mounted on the cam shaft so as to surround the rotor, a plurality of chambers which are defined between the rotational transmitting member and the cam shaft, each having a pair of circumferentially opposed walls, a plurality of vanes which are provided with the cam shaft and which extend outwardly therefrom in the radial direction into the chambers so as to divide each of chambers into advancing chambers and delaying chambers, and a coil-spring which is connected with and between the cam shaft and the rotational transmitting member so as to expand the advancing chambers. The coil-spring is located in a depression of the rotational transmitting member. In particular, one end of the coil-spring is affixed to the rotational transmitting member and the other end of the coil-spring is affixed to the cam shaft. The coil-spring includes a coil portion which is disposed in the depression of the rotational transmitting member.

One purpose of locating the coil-spring to expand the advancing chambers is to counteract a delaying direction force to delay the cam shaft, when the engine is driven. The delaying direction force occurs because the fluid chambers and vanes are disposed within a rotating power transmitting passage from the rotational transmitting member to the cam shaft. Therefore, when the cam shaft relatively rotates against the rotational transmitting member in the advancing direction or the delaying direction, the rotation to the advancing side is quicker than the rotation to the delaying side. In the above prior art device, the force of the coil-spring offsets the delaying direction force such that the response of the rotation to the advancing side occurs quickly.

However, the coil portion is not affixed to restrict the radial movement and the axial movement. Rather, both ends of the coil-spring are only affixed to the rotational transmitting member and the cam shaft, respectively. As shown in FIG. 4, an end portion (the first coil) 200*a* of a coil portion 200 interferes with an inside surface of a depression 201 of the rotational transmitting member, when the cam shaft relatively rotates against the rotational transmitting member to the advancing side or the delaying side. Thus, the friction between the end portion 200*a* and the inside surface of the depression 201 occurs such that the rotational friction between the rotational transmitting member and the cam shaft is increased. Further, at the inside space of the coil portion 200, if there is a member (although not shown in FIG. 4) which is fixed to a cam shaft, an end portion (the first coil) 200*b* of the coil portion 200 also interferes with the outer surface of the member such that the rotational friction increases. Therefore, the relative rotation between the rotational transmitting member and the cam shaft is not smooth.

SUMMARY OF THE INVENTION

Accordingly, it is an object of the present invention to provide an improved valve timing control device without the foregoing drawbacks.

In accordance with the present invention, a valve timing control device comprises a cam shaft rotatably assembled within a cylinder head of an engine, a rotational transmitting member mounted around the peripheral surface of the cam shaft so as to rotate relative thereto within a predetermined range for transmitting rotational power from a crank pulley, a plurality of vanes provided on the cam shaft or the rotational transmitting member, fluid chambers formed between the cam shaft and the rotational transmitting member and separated into advancing chambers and delaying chambers by the vanes, a fluid supplying means for supplying fluid under pressure, to at least a selected one of the advancing chambers and the delaying chambers, a coil-spring disposed between the cam shaft and the rotational transmitting member so as to expand one of the advancing chambers and the delaying chambers, and a restricting means for restricting the radial movement of the coil-spring.

Other objects and advantages of the invention will become apparent during the following discussion of the accompanying drawings.

DESCRIPTION OF THE DRAWING FIGURES

The foregoing and additional features of the present invention will become more apparent from the following detailed description of a preferred embodiment thereof when considered with reference to the attached drawings, in which.

DETAILED DESCRIPTION OF THE PREFERRED EMBODIMENTS

A valve timing control device in accordance with a preferred embodiment of the present invention will be described with reference to the attached drawings.

Figure 1:
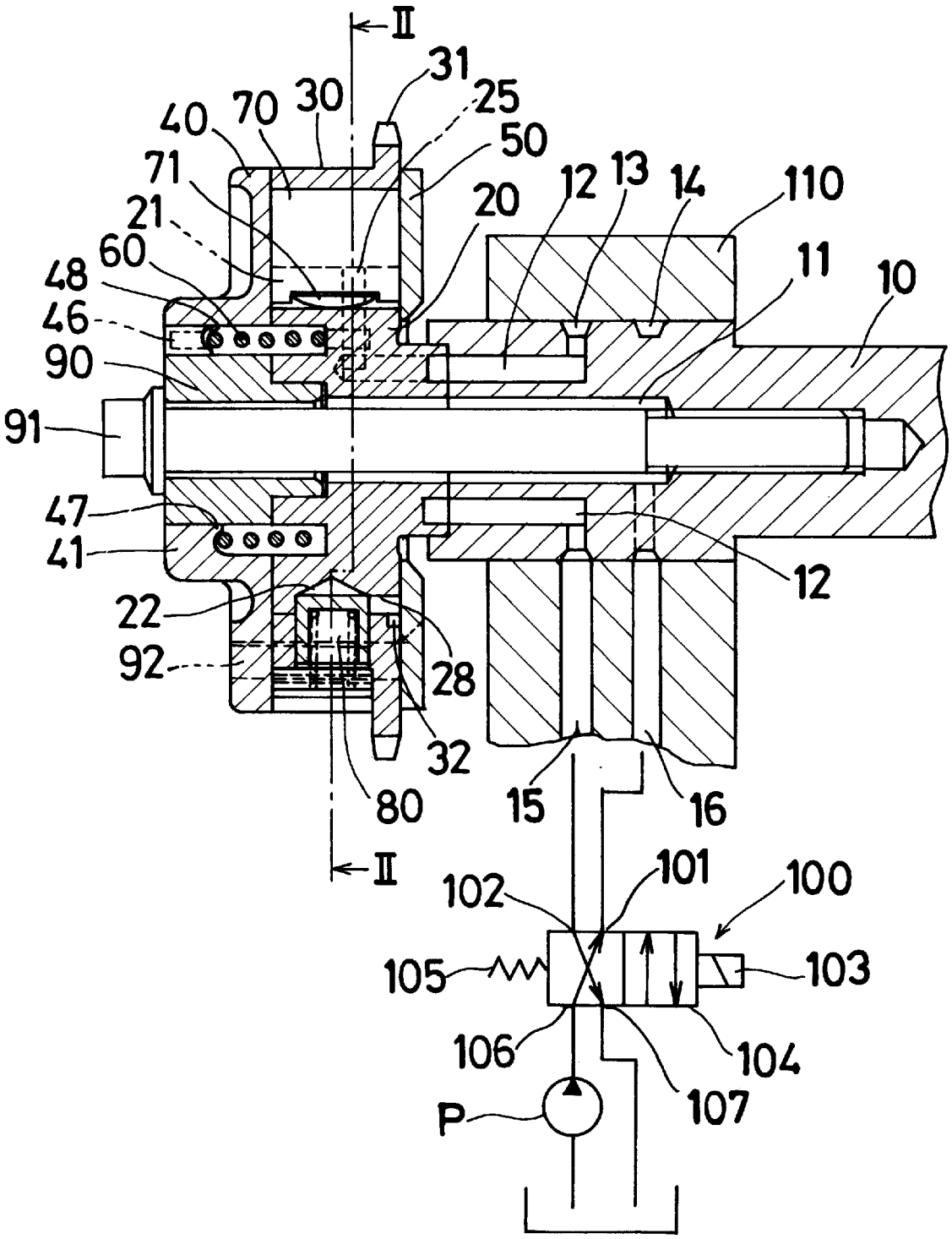
FIG. 1 is a sectional view of the embodiment of a valve timing control device in accordance with the present invention.
Figure 2:
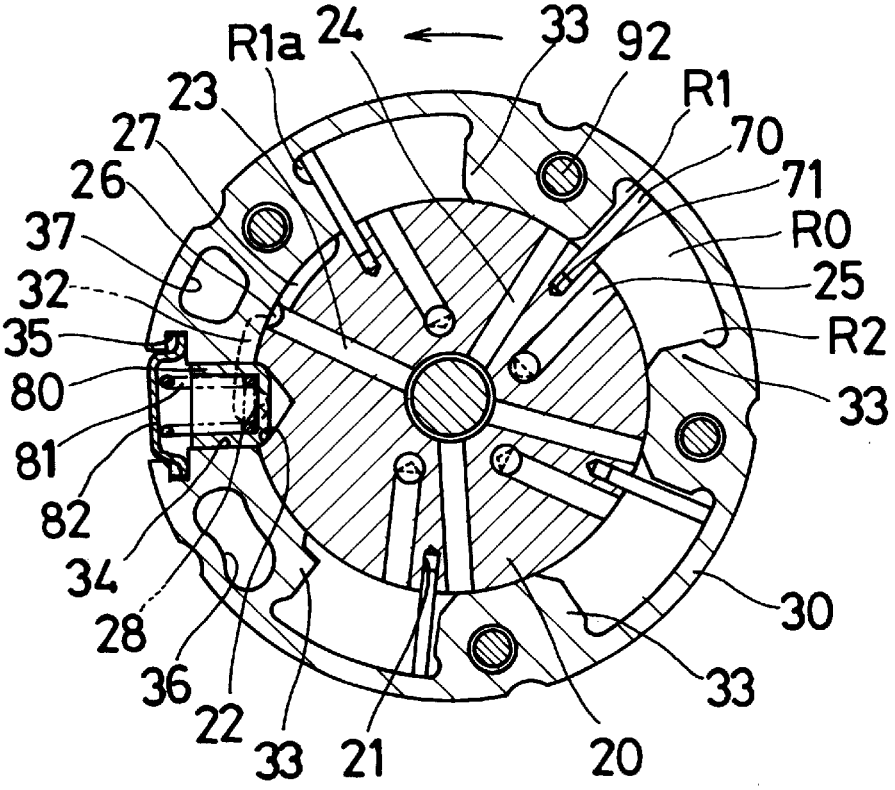
FIG. 2 is a section taken along the line II—II in FIG. 1 in accordance with the present invention.

A valve timing control device according to the present invention, as shown in FIGS. 1 and 2, is constructed so as to comprise a valve opening/closing shaft including a cam shaft 10 rotatably supported by a cylinder head 110 of an internal combustion engine, and a rotary shaft which has an internal rotor 20 integrally provided on the leading end portion of the cam shaft 10; a rotational transmitting member mounted around the rotary shaft so as to rotate relative thereto within a predetermined range and including an external rotor 30, a front plate 40, a rear plate 50 and a timing sprocket 31 which is integrally formed around the external rotor 30; a torsion spring 60 which is disposed between the internal rotor 20 and the front plate 40; four vanes 70 assembled with the internal rotor 20; and a locking pin 80 which is assembled with the external rotor 30. Here, the timing sprocket 31 is constructed, as is well known in the art, to transmit the rotating power in the counter-clockwise direction of FIG. 2 from a crank pulley 61 through a timing belt 62 made of resin or rubber shown in FIG. 1.

The cam shaft 10 is equipped with the well-known cam (not shown) for opening/closing an exhaust valve (not shown) and is provided therein with a delay passage 11 and an advance passage 12, which extend in the axial direction of the cam shaft 10. The delay passage 11 is connected to a connection port 101 of a change-over valve 100 via an annular passage 14 and a connection passage 16. On the other hand, the advance passage 12 is connected to a connection port 102 of the change-over valve 100 via an annular passage 13 and a connection passage 15.

The change-over valve 100 is able to move a spool 104 leftward of FIG. 1 against the action of a coil spring 105 by energizing a solenoid 103. The change-over valve 100 is so constructed as to establish, when deenergized, communication between a feed port 106, as connected to an oil pump P to be driven by the internal combustion engine, and the connection port 101 and the communication between the connection port 102 and exhaust port 107. When energized, the change-over valve 100 establishes communication between the feed port 106 and the connection port 102 and the communication between the connection port 101 and an exhaust port 107. As the result, the working oil is fed to the delay passage 11 when the solenoid 103 is deenergized, and to the advance passage 12 when the same is energized.

The internal rotor 20 is integrally fixed in the cam shaft 10 via a spacer 90 by means of a bolt 91 and is provided with four axial grooves 21 for mounting the four vanes 70 individually in radial directions. Further, the internal rotor 20 is provided with a receiving bore 22 into which a head portion of a locking pin 80 is fitted by a predetermined amount when the relative phase between the internal rotor 20 and the external rotor 30 is at a predetermined phase (the maximum advanced condition) as shown in FIG. 2; a passage 23 connected to the delay passage 11, for feeding/discharging the working oil to and from the receiving bore 22; passages 24 connected to the delay passage 11, for feeding/discharging the working oil to and from delaying chambers R1; and passages 25 connected to the advance passage 12, for feeding/discharging the working oil to and from advancing chambers R2. Here, each vane 70 is urged radially outward by a spring 71 (as shown in FIG. 1) fitted in the bottom portion of the vane groove 21. A delaying chamber R1*a* is fed the working oil via a passage 27 which is defined on the outer circumference of the internal rotor 20. Further, an axial groove 28 is formed on the outer circumferential surface of the internal rotor 20 so as to extend from the opening end of the receiving bore 22 toward the rear plate 50. An axial groove 26 is formed on the outer circumferential surface of the internal rotor 20 so as to extend from the opening end of the passage 23 toward the rear plate 50. These axial grooves 26 and 28 communicate with each other via a groove 32 which is formed on the rear side surface of the external rotor 30 at the maximum delayed condition shown in FIG. 2. Therefore, the receiving bore 22 communicates with the delay passage 11 via the axial groove 28, the groove 32, the axial groove 26 and the passage 23 only when the relative phase between the internal rotor 20 and the external rotor 30 is in the maximum delayed condition.

The external rotor 30 is mounted on the outer circumference of the internal rotor 20 so as to be able to rotate a predetermined amount relative to the internal rotor 20. As shown in FIG. 1, the front plate 40 and the rear plate 50 are fluid-tightly connected on both sides of the external rotor 30, and the front plate 40, the rear plate 50 and the external rotor 30 are fastened by bolts 92. The timing sprocket 31 is integrally formed on the outer circumference of the rear end of the external rotor 30. Further, four projecting portions 33 which project inwardly are formed on the inner circumferential portion of the external rotor 30. The inner circumferential surface of each of the projecting portions 33 is slidably mounted on the internal rotor 20. A retracting bore 34 in which the locking pin 80 and a spring 81 are disposed is formed in one of the projecting portions 33 whereby hollow portions 36, 37 are formed in this projecting portion 33.

The front plate 40 is a circular plate having a tubular portion 41 and communicating holes (not shown) which correspond to the hollow portions 36, 37 formed therein. The front plate 40 is provided with a notch portion 46 with which one end of the torsion spring 60 is engaged. The rear plate 50 is a circular plate and is provided with communicating holes (not shown) which correspond to the hollow portions 36 and 37.

The one end of the torsion spring 60 is engaged with the front plate 40, and the other end of the torsion spring 60 is engaged with the internal rotor 20 at its the outer end. The torsion spring 60 urges the internal rotor 20 relative to the external rotor 30, the front plate 40 and the rear plate 50 counter-clockwise in FIG. 2. The torsion spring 60 is provided consideration of the force which obstructs the rotation of the internal rotor 20 and the vanes 70 toward the advanced side. The torsion spring 60 urges the internal rotor 20 relative to the external rotor 30, the front plate 40 and the rear plate 50 toward the advanced side and thereby improves the response of the rotation of the internal rotor 20 toward the advanced side.

Figure 3:
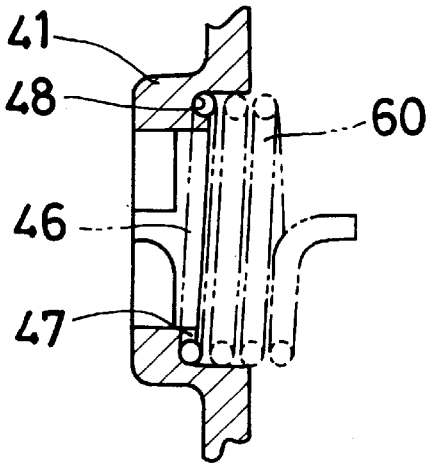
FIG. 3 is a fragmentary sectional view of a depression of a front plate in accordance with the present invention.
Figure 4:
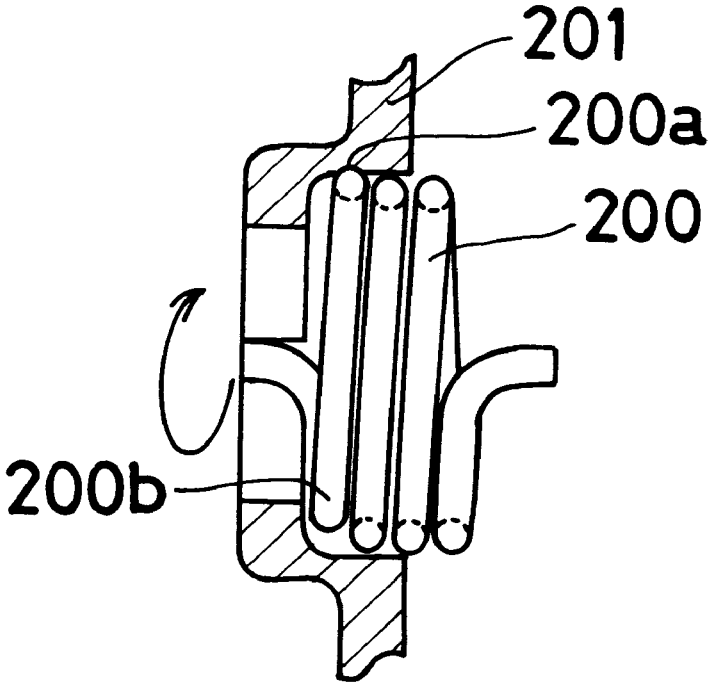
Fig. 4 PRIOR ART
FIG. 4 is a fragmentary sectional view of a depression in accordance with the prior art.

In this embodiment, as shown in FIG. 3, there is a circular projection 47 on the inside end of the tubular portion 41. The circular projection 47 extends toward the inner space of a coil portion of the torsion spring 60 and is able to engage with an end portion (the first coil) of the coil portion. Further, there is a spiral groove 48 on the outer surface of the circular projection 47 and the inside surface of the tubular portion 41. The spiral groove 48 is able to receive the end portion (the first coil) of the coil portion of the torsion spring 60.

Each of the vanes 70 is disposed in each of the pressure chambers RO formed between the adjacent projecting portions 33 and divides the pressure chamber RO into the advancing chamber R2 and the delaying chamber R1, R1*a*.

The locking pin 80 is fitted in the retracting bore 34 so as to be able to move in the radial direction of the external rotor 30 and is urged toward the internal rotor 20 by the spring 81 which is disposed between the locking pin 80 and a plate-shaped retainer 82. In this embodiment, a groove 35 which penetrates the retracting bore 34 at the outer end of the retracting bore 34 and whose one end opens into the front side surface of the external rotor 30 is formed on the external rotor 30. The plate shaped retainer 82 is fitted into the groove 35 from the front side surface side of the external rotor 30 and the one end of the spring 81 is engaged with the retainer 82. The retainer 82 includes four projections. Each projection is located at the corner portions of the retainer 82 so as to engage with the groove 35 of the retracting bore 34. Accordingly, the head of the locking pin 80 is inserted into the receiving bore 22 so as to lock between the internal rotor 20 and the external rotor 30 at the maximum advanced condition as shown in FIG. 2.

In the above-described embodiment, the torsion spring 60 causes the internal rotor 20 to relatively rotate against both the external rotor 30, the front plate 40 and the rear plate 50 to the advancing side. Thus, if the fluid pressure in the delaying chambers R1, R1*a* and the advancing chambers R2 decreases because the engine is at rest and stops driving the oil pump P, the internal rotor 20 is rotated to the advanced side by the torsion spring 60 so as to lock between the internal rotor 20 and the external rotor 30 at the maximum advanced condition as shown in FIG. 2. Accordingly, when the engine is re-started, unnecessary relative rotation between the rotational shaft comprising the cam shaft 10, the internal rotor 20, the vanes 70 and so on and the rotational transmitting member composed of the external rotor 30, the timing sprocket 31, the front plate 40, the rear plate 50 and so on due to the large rotational variation is regulated. Thus, the drawback of unnecessary relative rotation between the rotational shaft and the rotational transmitting member (for example, collision noise by the vanes 70) is avoided.

Further, when the oil pump P is driven by the engine and the change-over valve 100 is changed over, the oil is supplied from the oil pump P to the delaying chambers R1 via delay passage 11 and the passages 24, and the oil is fed from the advancing chambers R2 via the passages 25 and the advance passage 12. At the same time, the oil is supplied from the oil pump P to the delaying chamber R1*a* via the delay passage 11, the passage 23 and the passage 27 and to the receiving bore 22 via the delay passage 11, the passage 23, the axial groove 26, the groove 32 and the axial groove 28. Consequently, the head portion of the locking pin 80 moves into the retracting bore 34 from the receiving bore 22 against the action of the spring 81 so as to avoid locking the relative phase between the internal rotor 20 and the external rotor 30 such that the rotational shaft comprising the cam shaft 10, the internal rotor 20, the vanes 70 and so on rotates in the delaying direction (the clockwise direction of FIG. 2). Here, after rotating the rotational shaft within a predetermined range, the communication between the passage 23 and receiving bore 22 is delayed such that vibrations in the locking pin 80 are stopped by the pulsation of the oil.

In this condition, when the head portion of the locking pin 80 is not inserted in the receiving bore 22 and the changeover valve 100 is not changed over, the oil is supplied from the oil pump P to the advancing chambers R2 via the advance passage 12 and the passages 23; and the oil is fed from the delaying chambers R2 via the passages 24 and the delay passage 11. Thus, the rotational shaft comprising the cam shaft 10, the internal rotor 20, the vanes 70 and so on rotates in the delaying direction (the clockwise direction of FIG. 2).

In the above embodiment, there are a circular projection 47 and a spiral groove 48 such that the end portion (the first coil) of the coil portion of the torsion spring 60 is restricted to the radial movement and the axial movement. Therefore, when the internal rotor 20 relatively rotates against the external rotor 30, the front plate 40 and the rear plate 50, the end portion of the coil portion of the torsion spring 60 does not move in the radial and axial directions by the twist force of the torsion spring 60 such that friction related with the end portion, does not occur. This prevents the rotational friction between the internal rotor 20 and the external rotor 30 and so on such that the relative rotation between them is smooth.

On the other hand, the embodiment has been constructed such that the head portion of the locking pin 80 assembled with the external rotor 30 in the state (the most advanced condition) where the delaying chambers R1, R1*a* take the minimum most capacity, is fitted in the fitting hole 22 of the internal rotor 20. However, the construction can be modified such that the head portion of the locking pin 80, as assembled with the external rotor 30, is fitted in the fitting hole 22 of the internal rotor 20 in the state (the most delayed condition) where the advancing chambers R2 take minimum capacity.

In the aforementioned embodiment, on the other hand, the invention has been used in the valve timing control device to be assembled with the cam shaft 10 for the exhaust valve. However, the invention can likewise be practiced by a valve timing control device to be assembled with the cam shaft 10 for an intake valve.

While the invention has been described in detail and with reference to specific embodiments thereof, it will be apparent to one skilled in the art that various changes and modifications can be made therein without departing from the spirit and scope thereof.

What is claimed is:

1. A valve timing control device comprising:

a cam shaft rotatably assembled within a cylinder head of an engine;

a rotational transmitting member mounted around the peripheral surface of the cam shaft so as to rotate relative thereto within a predetermined range for transmitting rotational power from a crank pulley;

a plurality of vanes provided on at least one of the cam shaft and the rotational transmitting member;

fluid chambers formed between the cam shaft and the rotational transmitting member, and separated into advancing chambers and delaying chambers by the vanes;

a fluid supplying means for supplying fluid under pressure to at least a selected one of the advancing chambers and the delaying chambers;

a coil-spring having a coil portion, the coil spring disposed between the cam shaft and the rotational transmitting member so as to expand one of the advancing chambers and the delaying chambers; and a restricting means for restricting the radial movement of the coil-spring so as to prevent the coil portion from interfering with at least one of the cam shaft and the rotational transmitting member.

2. A valve timing control device as claimed in claim 1, wherein the restricting means includes a projection which engages with an inner surface of the coil portion of the coil-spring.

3. A valve timing control device in claim 2, wherein the restricting means further includes a spiral groove which receives an end of the coil portion of the coil-spring.

4. A valve timing control device comprising:

a cam shaft rotatably assembled within a cylinder head of an engine;

a rotational transmitting member mounted around the peripheral surface of the cam shaft so as to rotate relative thereto within a predetermined range for transmitting rotational power from a crank pulley;

a plurality of vanes provided on at least one of the cam shaft and the rotational transmitting member;

fluid chambers formed between the cam shaft and the rotational transmitting member, and separated into advancing chambers and delaying chambers by the vanes;

a fluid supplying means for supplying fluid under pressure to at least a selected one of the advancing chambers and the delaying chambers;

a spring having a spring portion and two connecting portions, one of which is connected with the cam shaft and the other of which is connected with the rotational transmitting member, such that the spring expands one of the advancing chambers and the delaying chambers; and a restricting means for restricting the radial movement of the spring so as to prevent the spring portion from interfering with at least one of the cam shaft and the rotational transmitting member.

* * * * *